US010162299B2

(12) United States Patent
Nakamura et al.

(10) Patent No.: US 10,162,299 B2
(45) Date of Patent: Dec. 25, 2018

(54) IMAGE FORMING APPARATUS

(71) Applicant: KYOCERA Document Solutions Inc., Osaka-shi, Osaka (JP)

(72) Inventors: Arata Nakamura, Osaka (JP); Takeshi Watanabe, Osaka (JP)

(73) Assignee: KYOCERA DOCUMENT SOLUTIONS INC., Osaka-Shi, Osaka (JP)

( * ) Notice: Subject to any disclaimer, the term of this patent is extended or adjusted under 35 U.S.C. 154(b) by 0 days.

(21) Appl. No.: 15/491,281

(22) Filed: Apr. 19, 2017

(65) Prior Publication Data

US 2017/0315490 A1 Nov. 2, 2017

(30) Foreign Application Priority Data

Apr. 27, 2016 (JP) ..... 2016-088885

(51) Int. Cl.
*G03G 15/00* (2006.01)
*G03G 15/16* (2006.01)

(52) U.S. Cl.
CPC ..... *G03G 15/6529* (2013.01); *G03G 15/16* (2013.01); *G03G 15/6558* (2013.01); *G03G 2215/00675* (2013.01)

(58) Field of Classification Search
CPC ..... G03G 15/6529
USPC ..... 399/388
See application file for complete search history.

(56) References Cited

U.S. PATENT DOCUMENTS 4,469,322 A * 9/1984 Kogure ..... B65H 5/38 271/264
6,980,766 B2 * 12/2005 Ito ..... G03G 15/234 271/226
8,055,171 B2 * 11/2011 Ueyama ..... G03G 15/6558 399/316
2004/0253025 A1 * 12/2004 Matsuura ..... G03G 15/167 399/316
2006/0171760 A1 * 8/2006 Deguchi ..... G03G 15/165 400/642
2007/0231032 A1 * 10/2007 Matsuno ..... G03G 15/6558 399/388
2010/0322662 A1 * 12/2010 Kusakabe ..... G03G 15/0898 399/92

(Continued)

FOREIGN PATENT DOCUMENTS

JP 2011-2594 1/2011

*Primary Examiner* — Anthony Nguyen
(74) *Attorney, Agent, or Firm* — Gerald E. Hespos; Michael J. Porco; Matthew T. Hespos

(57) ABSTRACT

An image forming apparatus includes an image carrier, a developing section, a transfer section, a pre-transfer conveyance passage, and a guide member. The pre-transfer conveyance passage allows conveyance of the sheet from the developing section to the transfer section. The guide member defines a side of the pre-transfer conveyance passage that faces the transfer surface. The guide member includes: a guide body having a guide surface that faces the transfer surface of the sheet; and a tip section having a curved portion joining an end edge of the guide body, and a distal edge that is on a downstream side in the conveyance direction and faces the image carrier. The distal edge is located at such a position as to allow the transfer surface of the sheet to lie at a space therefrom when a leading end of the sheet is in contact with the image carrying surface.

9 Claims, 6 Drawing Sheets

(56) References Cited

U.S. PATENT DOCUMENTS

2014/0219693 A1* 8/2014 Uchida ..... G03G 15/6529
399/316

* cited by examiner

IMAGE FORMING APPARATUS

INCORPORATION BY REFERENCE

This application is based on Japanese Patent Application No. 2016-88885 filed with the Japan Patent Office on Apr. 27, 2016, the contents of which are hereby incorporated by reference.

BACKGROUND

The present disclosure relates to an image forming apparatus for transferring a developer image onto a sheet.

An image forming apparatus for transferring a developer image onto a sheet includes: a photoconductive drum having an image carrying surface for carrying a developer image thereon; a developing roller facing the image carrying surface and defining a developing nip therewith; a transfer roller being in contact with the image carrying surface and defining a transfer nip therewith; and a pair of registration rollers for conveying a sheet to the transfer nip. Developer is supplied from the developing roller to the image carrying surface at the developing nip to form a developer image, and then a sheet passes through the transfer nip at which the developer image formed on the image carrying surface is transferred onto a sheet surface. As an example of such image forming apparatus, there is known an apparatus including a guide. The guide is disposed immediately upstream of the transfer nip in a sheet conveyance direction for guiding the sheet being conveyed by the pair of registration rollers to the transfer nip.

SUMMARY

An image forming apparatus according to an aspect of the present disclosure includes an image carrier, a developing section, a transfer section, a pre-transfer conveyance passage, and a guide member.

The image carrier has an image carrying surface for carrying thereon a developer image that is to be transferred onto a sheet, and is rotatable about an axis extending in a first direction perpendicularly intersecting a sheet conveyance direction. The developing section supplies developer to the image carrying surface to form the developer image. The transfer section transfers the developer image formed on the image carrying surface onto a transfer surface of the sheet. The pre-transfer conveyance passage allows conveyance of the sheet from the developing section to the transfer section. The guide member defines a side of the pre-transfer conveyance passage that faces the transfer surface.

The guide member includes: a guide body in the form of a plate and having a guide surface that faces the transfer surface of the sheet substantially in parallel, the sheet being conveyed in the conveyance direction; and a tip section having a curved portion joining an end edge of the guide body that is on a downstream side in the conveyance direction and defining an outer bulge of the pre-transfer conveyance passage, the curved portion extending in a second direction perpendicularly intersecting both the sheet conveyance direction and the first direction, and a distal edge that is on a downstream side in the conveyance direction and faces the image carrier. The distal edge of the tip section is located at such a position as to allow the transfer surface of the sheet having been conveyed along the guide surface to lie at a space therefrom when a leading end of the sheet is in contact with the image carrying surface of the image carrier.

These and other objects, features and advantages of the present disclosure will become more apparent upon reading the following detailed description along with the accompanying drawings.

DETAILED DESCRIPTION

Figure 1:
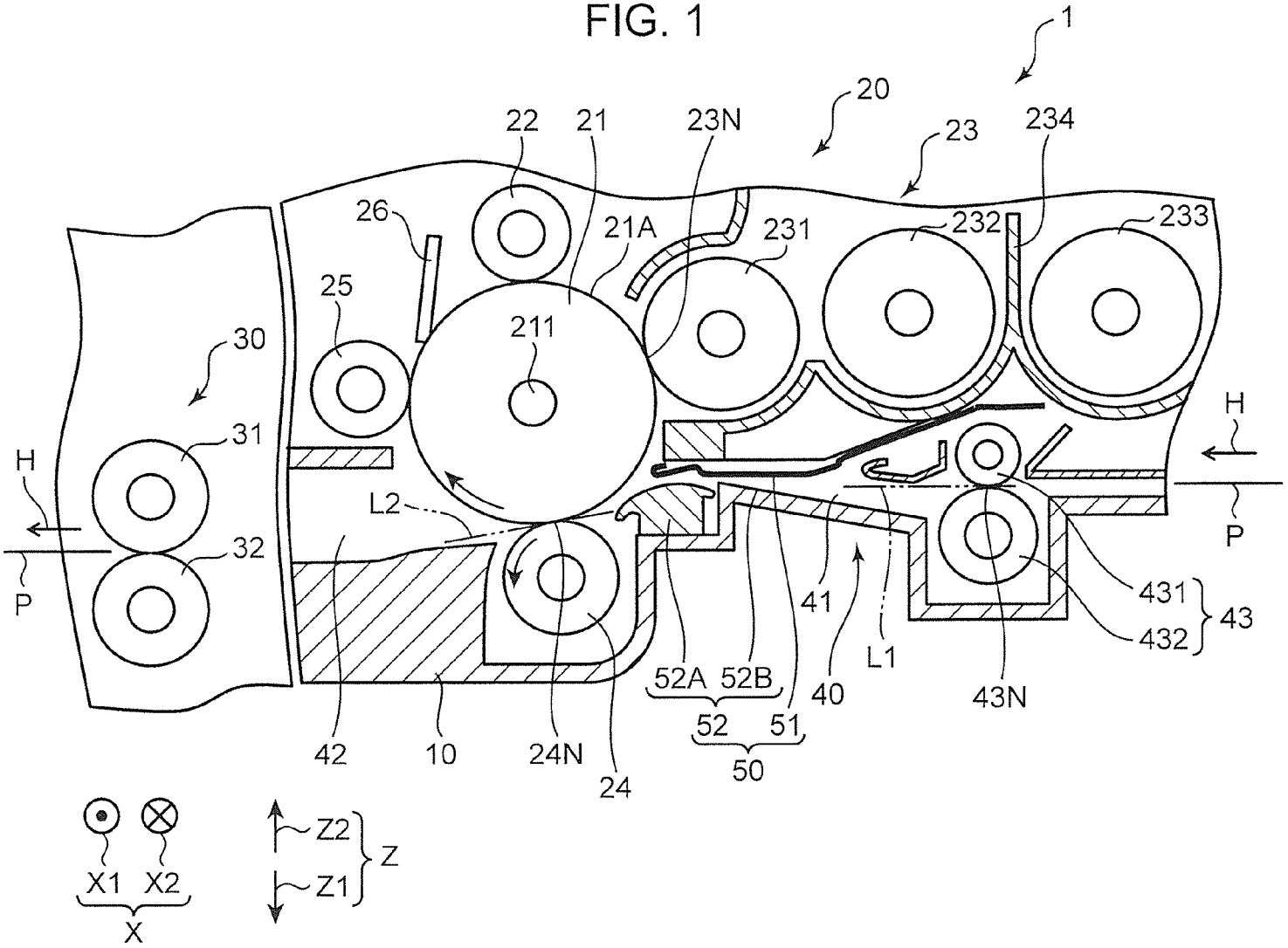
FIG. 1 is a schematic view showing a configuration of an image forming apparatus according to an embodiment of the present disclosure.

Hereinafter, an image forming apparatus according to an embodiment of the present disclosure will be described with reference to the accompanying drawings. FIG. 1 is a schematic view showing a configuration of an image forming apparatus 1 according to an embodiment of the present disclosure. The image forming apparatus 1 is provided as a printer, a copier, a facsimile apparatus or a multifunctional apparatus equipped with these functions, for example. The term "sheet" used in the description hereinafter refers to a copy paper, a coated paper, an OHP sheet, a thick paper, a postcard, a tracing paper, or sheets of other materials that are subjected to image formation or any other processes.

The image forming apparatus 1 includes an apparatus body 10, and an image formation section 20, a fixing section 30, a sheet conveyance passage 40, and a sheet conveyance guide section 50 that are disposed in the apparatus body 10.

The image forming section 20 forms a developer image (toner image) on a sheet P, and includes a photoconductive drum 21 (image carrier), a charging roller 22, a developing portion 23, a transfer roller 24, a sliding roller 25, and a cleaning blade 26.

The photoconductive drum 21 is in the form of a cylinder and has a circumferential surface serving as an image carrying surface 21A for carrying thereon an electrostatic latent image and a developer image. The photoconductive drum 21 is supported on the apparatus body 10 rotatably about a drum rotational axis 211 extending in a predetermined first direction X. The photoconductive drum 21 rotates about the drum rotational axis 211 upon receipt of a torque from an unillustrated motor. In the present embodiment, the first direction X refers to a horizontal direction (left/right direction), one side X1 in the first direction X referring to a right side and the other side X2 opposite to the one side X1 in the first direction X referring to a left side.

The charging roller 22 comes into contact with the image carrying surface 21A of the photoconductive drum 21, and uniformly charges the image carrying surface 21A. The charged image carrying surface 21A is irradiated with beams of laser light emitted from an unillustrated exposure device. Consequently, an electrostatic latent image is formed on the image carrying surface 21A of the photoconductive drum 21.

The developing portion 23 supplies developer (toner) to the image carrying surface 21A of the photoconductive drum 21 carrying an electrostatic latent image to form a developer image. The developing section 23 is detachably mounted to the apparatus body 10. The developing portion 23 includes a developing housing 234, and a developing roller 231, a first stirring member 232, and a second stirring member 233 that are disposed in the developing housing 234.

In the developing portion 23, the developing roller 231 extends in parallel to the photoconductive drum 21 in the first direction X, and is axially rotatably supported on the developing housing 234. The developing roller 231 has a circumferential surface that faces the image carrying surface 21A of the photoconductive drum 21 and defines a developing nip 23N therewith. The developing roller 231 supplies developer to the image carrying surface 21A of the photoconductive drum 21 at the developing nip 23N to form a developer image.

In the developing portion 23, the first stirring member 232 and the second stirring member 233 are disposed in parallel to the developing roller 231, and rotatably supported on the developing housing 234. The first stirring member 232 and the second stirring member 233 rotate to thereby supply developer to the developing roller 231 while stirring developer existing in the developing housing 234.

The transfer roller 24 extends in parallel to the photoconductive drum 21 in the first direction X, and is axially rotatably supported on the apparatus body 10. The transfer roller 24 has a circumferential surface that is in contact with the image carrying surface 21A of the photoconductive drum 21 and defines a transfer nip 24N therewith. The transfer roller 24 transfers a developer image carried on the image carrying surface 21A of the photoconductive drum 21 onto a sheet P at the transfer nip 24N. Specifically, the transfer roller 24 is in the form of an elastic roller having conductivity, and applies a transfer bias to a sheet P from a rear side of the sheet P when the sheet P passes through the transfer nip 24N. The application of electric charge to the sheet P allows a developer image carried on the image carrying surface 21A of the photoconductive drum 21 to be transferred to the sheet P at the transfer nip 24N. The transfer roller 24 serves an example of a transfer section.

The sliding roller 25 has a circumferential surface that comes into contact with the image carrying surface 21A of the photoconductive drum 21 with a biasing force, to clean the image carrying surface 21A. The cleaning blade 26 comes into sliding contact with the image carrying surface 21A of the photoconductive drum 21 to remove developer remaining on the image carrying surface 21A.

The fixing section 30 is disposed downstream of the image forming section 20 in a predetermined sheet conveyance direction H perpendicularly intersecting the first direction X, and fixes a developing image transferred onto a sheet P. The fixing section 30 includes a fixing roller 31 including a built-in heater, and a pressurizing roller 32 facing the fixing roller 31. The pressurizing roller 32 has a circumferential surface that is in pressed contact with a circumferential surface of the fixing roller 31, thereby defining a fixing nip. The fixing section 30 conveys a sheet P having a developer image transferred thereon, while heating and pressurizing the sheet P by the fixing roller 31 and the pressurizing roller 32. In this manner, the developer image is fixed on the sheet P.

The sheet conveyance passage 40 serves as a path for allowing conveyance of a sheet P by way of the image forming section 20 and the fixing section 30. When the sheet conveyance direction H is defined as a direction in which a sheet P is conveyed, the sheet conveyance passage 40 includes a pre-transfer conveyance passage 41 disposed upstream of the transfer nip 24N and a post-transfer conveyance passage 42 disposed downstream of the transfer nip 24 in the sheet conveyance direction H. Both the pre-transfer conveyance passage 41 and the post-transfer conveyance passage 42 allow conveyance of a sheet P in the sheet conveyance direction H. The sheet conveyance direction H refers to a substantially horizontal direction. The pre-transfer conveyance passage 41 is disposed on one side Z1 with respect to the developing section 23 in a second direction Z perpendicularly intersecting both the first direction X and the sheet conveyance direction H, and serves to guide a sheet P being conveyed in the sheet conveyance direction H to the transfer nip 24N. The post-transfer conveyance passage 42 serves to guide a sheet P having passed through the transfer nip 24N to the fixing section 30.

At an upstream end of the pre-transfer conveyance passage 41, there is disposed a pair of registration rollers 43 (an example of a pair of conveyance rollers). In other words, the pair of registration rollers 43 is disposed upstream of the sheet conveyance guide section 50 in the sheet conveyance direction H, the sheet conveyance guide section 50 being disposed in the pre-transfer conveyance passage 41 as described later. A sheet P is temporarily stopped to be subjected to skew correction at the pair of registration rollers 43, and then advanced to the transfer nip 24N at a predetermined timing for image transfer.

The pair of registration rollers 43 includes a first roller 431 extending in the first direction X, and a second roller 432 facing the first roller 431. The first roller 431 is in pressed contact with the second roller 432 in the direction of the one side Z1 in the second direction Z, thereby defining a registration nip 43N. In the pair of registration rollers 43, the second roller 432 is disposed on the one side Z1 in the second direction Z and the first roller 431 is disposed on the other side Z2 opposite to the one side Z1 in the second direction Z. In the present embodiment, the second direction Z refers to a vertical direction, one side Z1 in the second direction Z referring to a lower side and the other side Z2 in the second direction Z referring to an upper side. The pair of registration rollers 43 conveys a sheet P to the transfer nip 24N by nipping the sheet P at the registration nip 43N.

In the present embodiment, in the pair of registration rollers 43, the first roller 431 serves as a driving roller that receives a driving force, and is in the form of a cylindrical metallic roller obtained by rolling a metal strip such as stainless steel. The second roller 432 serves as a driven roller that is rotated by rotation of the first roller 431, and is in the form of an elastic roller including a cylindrical core metal such as stainless steel and an elastic layer formed on the core metal, the elastic layer being made of a rubber or the like. Consequently, the second roller 432 can impart a conveyance force to a sheet P with an appropriate nip width and an appropriate pressure.

The sheet conveyance guide section 50 is disposed between the transfer nip 24N and the registration nip 43N in the pre-transfer conveyance passage 41, and serves to guide a leading end of a sheet P having passed through the registration nip 43N and being conveyed in the sheet conveyance direction H to the photoconductive drum 21. The sheet conveyance guide section 50 includes a first guide member 51 (guide member) disposed on the other side Z2 (hereinafter, referred to as "upper side Z2") in the second direction Z and a second guide member 52 disposed on the one side Z1 (hereinafter referred to as "lower side Z1") in the second direction Z.

In the sheet conveyance guide section 50, the first guide member 51 defines a side of the pre-transfer conveyance passage 41 that is on the upper side Z2. The first guide member 51 includes a downstream portion that is on a downstream side in the sheet conveyance direction H and defines the upper side Z2 of the pre-transfer conveyance passage 41, the downstream portion serving to guide a leading end of a sheet P to the photoconductive drum 21 while guiding a surface P1 (transfer surface) of the sheet P on which a developer image is to be transferred.

Further, in the sheet conveyance guide section 50, the second guide member 52 defines the other side of the pre-transfer conveyance passage 41 that is on the lower side Z1. The second guide member 52 guides the leading end of the sheet P to the photoconductive drum 21 while guiding a rear surface of the sheet P opposite to the surface on which a developer image is to be transferred. The second guide member 52 includes a downstream portion 52A lying at a downstream end of the pre-transfer conveyance passage 41 and an upstream portion 52B disposed upstream of the downstream portion 52A in the sheet conveyance direction H.

The downstream portion 52A has a curved surface projecting in the direction of the upper side Z2. The upstream portion 52B has an oblique surface sloping such that a downstream end thereof lies on the upper side Z2 with respect to an upstream end thereof in the sheet conveyance direction H. A leading end of a sheet P having passed through the registration nip 43N is guided to the photoconductive drum 21 by the first guide member 51 and the second guide member 52.

Figure 2A:
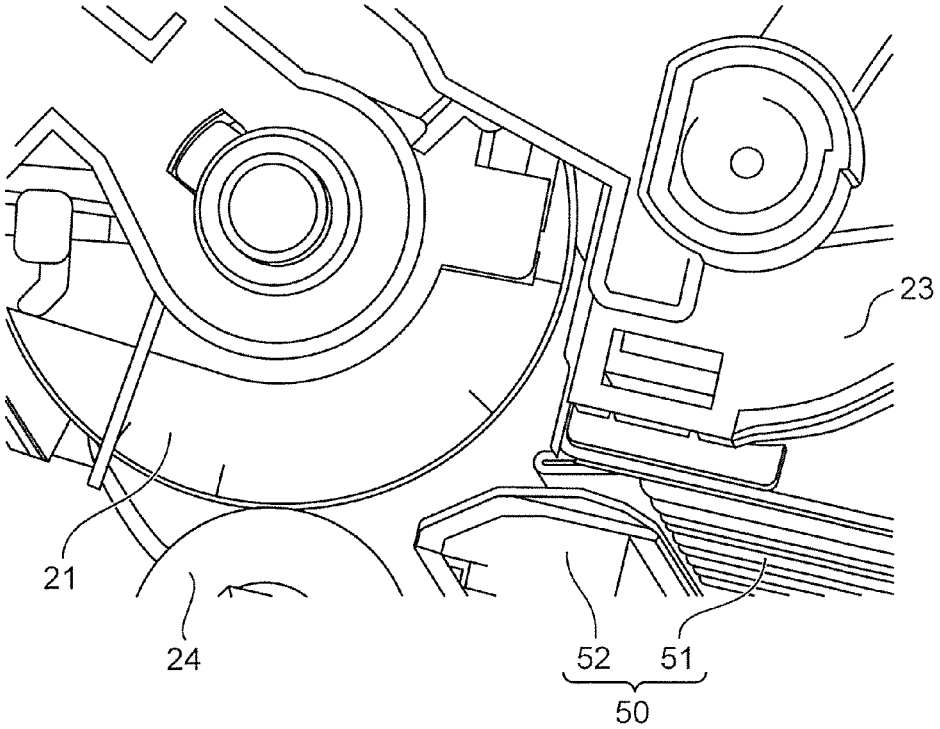
FIGS. 2A and 2B are enlarged perspective views of the vicinity of a first guide member in the image forming apparatus.
Figure 2B:
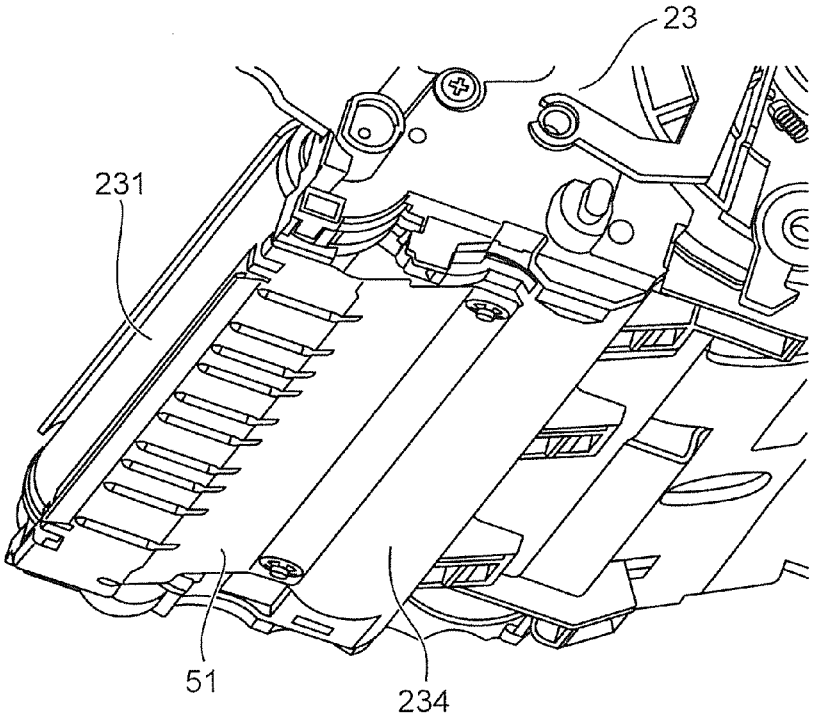
Figure 3:
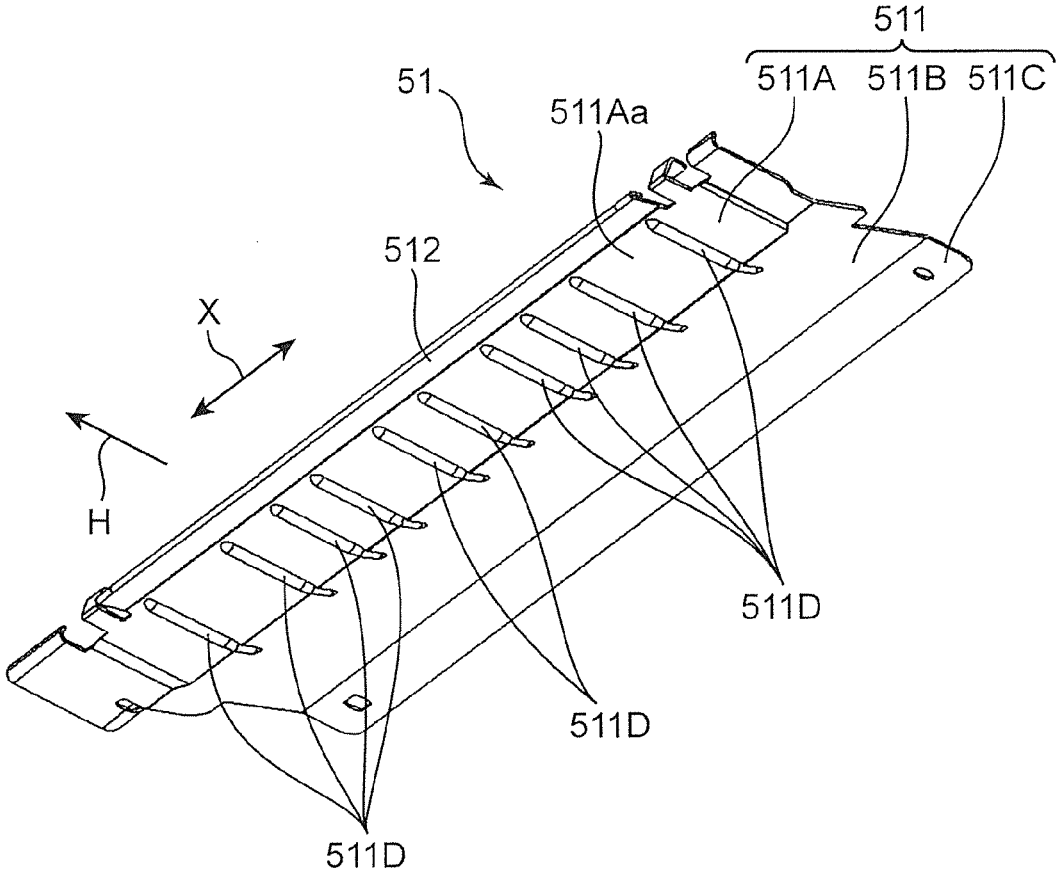
FIG. 3 is a perspective view showing a configuration of the first guide member.
Figure 4:
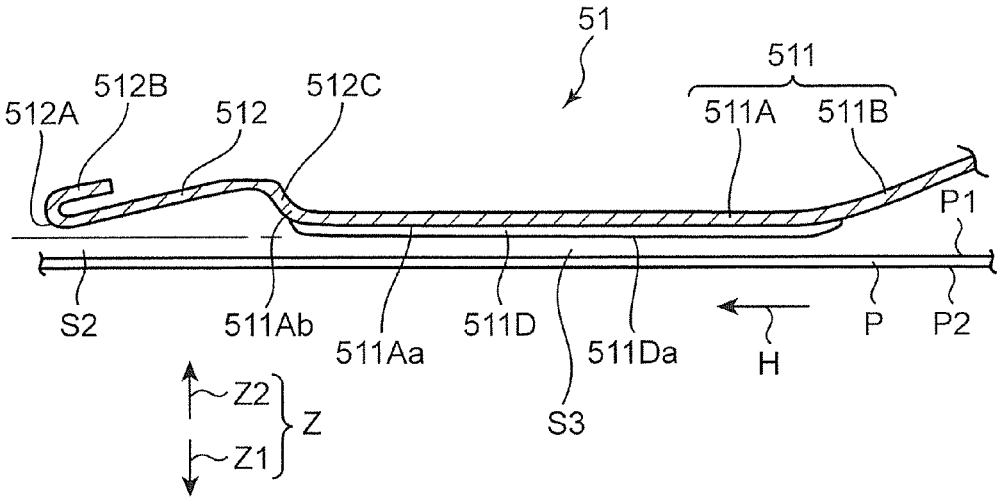
FIG. 4 is a sectional view of the first guide member.
Figure 5:
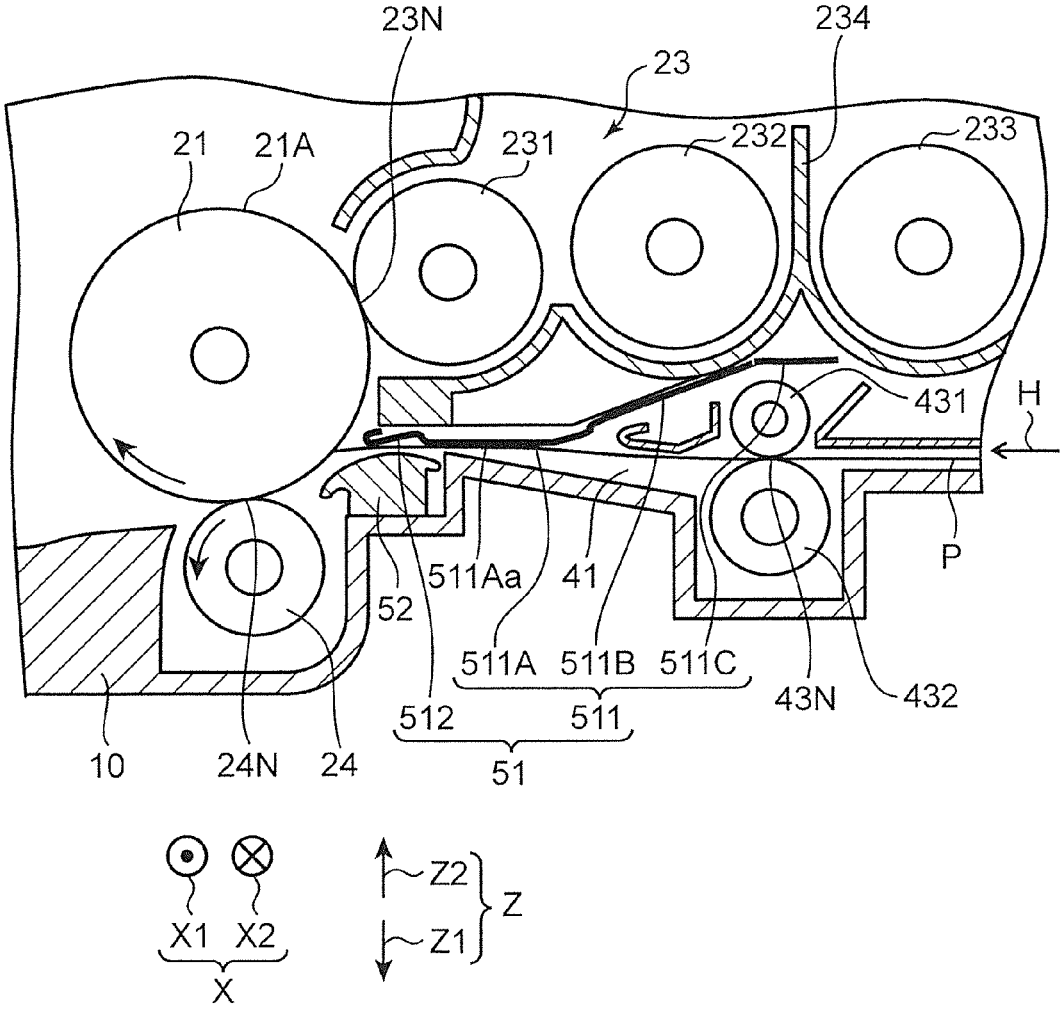
FIG. 5 is an explanatory view illustrating passage of a sheet along the first guide member.
Figure 6:
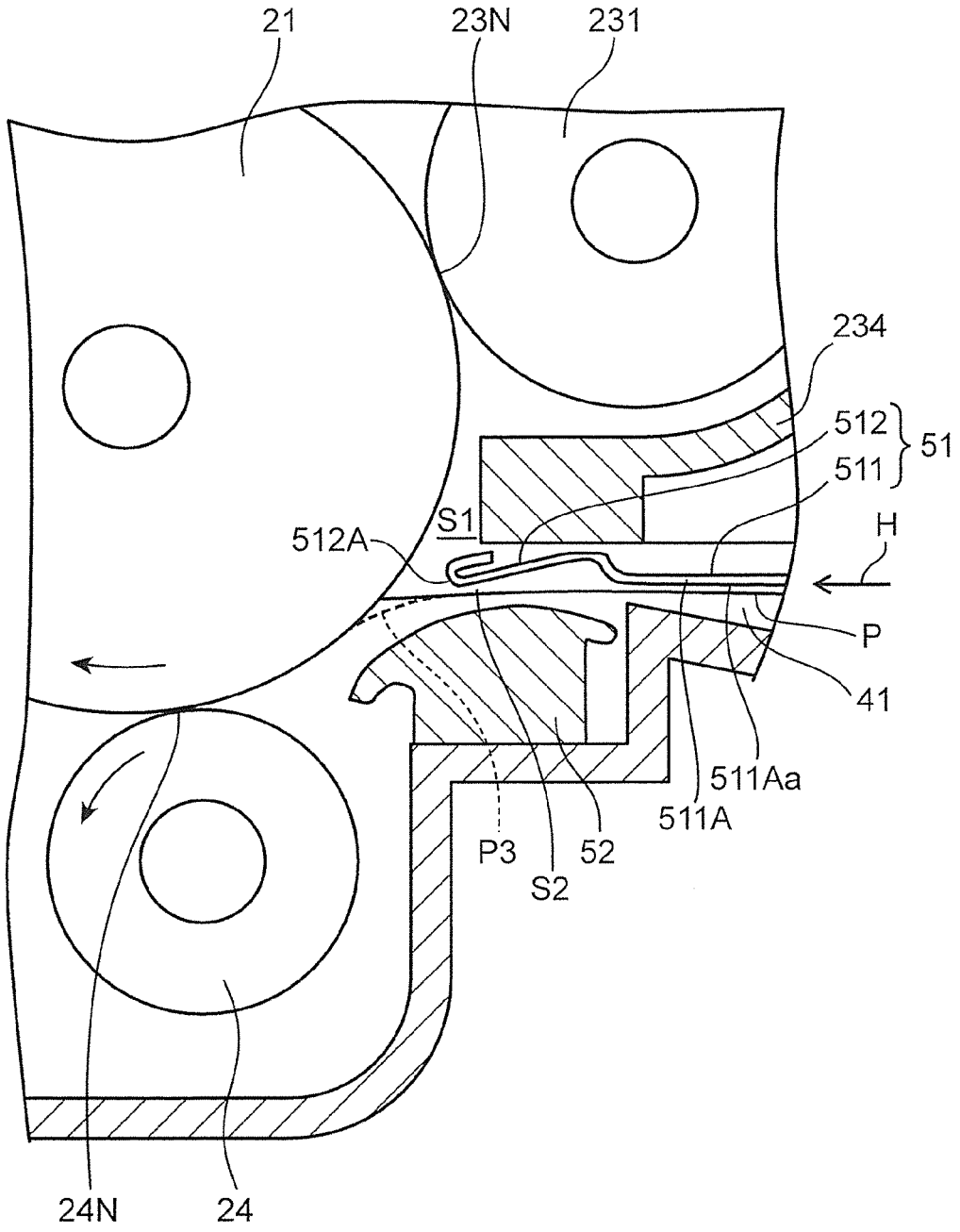
FIG. 6 is an explanatory view illustrating contact of a leading end of a sheet with a photoconductive drum, the sheet having passed by the first guide member.

Hereinafter, the first guide member 51 of the sheet conveyance guide section 50 will be described in detail. FIGS. 2A and 2B are enlarged perspective views of the vicinity of the first guide member 51. FIG. 3 is a perspective view showing a configuration of the first guide member 51, and FIG. 4 is a sectional view of the first guide member 51. FIG. 5 is an explanatory view illustrating passage of a sheet P along the first guide member 51. FIG. 6 is an explanatory view illustrating contact of a leading end of a sheet P with the photoconductive drum 21, the sheet P having passed by the first guide member 51.

The first guide member 51 is attached to a bottom wall lying on the lower side Z1 of the developing housing 234, as shown in FIGS. 2A and 2B. In other words, the developing section 23 is disposed on the upper side Z2 with respect to the first guide member 51 disposed at the pre-transfer conveyance passage 41. The attachment of the first guide member 51 to the developing housing 234 allows an accurate positioning of the first guide member 51 at a predetermined position to define the upper side Z2 of the pre-transfer conveyance passage 41 for guiding a sheet P to the transfer nip 24N. Further, as shown in FIG. 1, the pair of registration rollers 43 is disposed, not on a tangent line L2 of the transfer roller 24, but on the lower side Z1 with respect to the tangent line L2 in a plan view looking in the first direction X, the tangent line L2 passing through the transfer nip 24N.

The first guide member 51 includes a guide body 511 and a tip section 512. In the first guide member 51, the guide body 511 is in the form of a plate and has a guide surface 511Aa that faces a surface P1 of a sheet P having passed through the registration nip 43N and being conveyed in the sheet conveyance direction H.

In the first guide member 51, the guide body 511 has a shape extending along the bottom wall of the developing housing 234, and includes a flat portion 511A, an oblique portion 511B, and a fixed portion 511C. The flat portion 511A is substantially flat and constituting a most downstream portion of the guide body 511 in the sheet conveyance direction H. The flat portion 511A is formed with projections 511D. In the guide body 511, the oblique portion 511B joins an upstream end edge of the flat portion 511A in the sheet conveyance direction H. The oblique portion 511B slopes with respect to the flat portion 511A such that an upstream end thereof lies on the upper side Z2 with respect to a downstream end thereof in the sheet conveyance direction H. In the guide body 511, the secured portion 511C joins an upstream end edge of the oblique portion 511B in the sheet conveyance direction H. The secured portion 511C is secured to the bottom wall of the developing housing 234, whereby the first guide member 51 is attached to the developing housing 234.

In the first guide member 51, the tip section 512 is in the form of a plate, and joins a downstream end edge 511Ab of the guide body 511 in the sheet conveyance direction H. The tip section 512 has a distal edge 512A that is on a downstream side in the sheet conveyance direction H and faces the photoconductive drum 21 in the sheet conveyance direction H. The distal edge 512A of the tip section 512 is located at a greater distance from the pre-transfer conveyance passage 41 than the guide surface 511Aa of the guide body 511 to allow a surface P1 of a sheet P having been conveyed along the guide surface 511Aa to lie at a space S2 therefrom. In other words, the guide surface 511Aa (ridge parts 511Da of the projections 511D) of the guide body 511 lies on the lower side Z1 with respect to the distal edge 512A of the tip section 512. As shown in FIGS. 5 and 6, a sheet P having been conveyed along the guide surface 511Aa of the guide body 511 of the first guide body 51 is guided to the transfer nip 24N with a sheet leading end P3 thereof being deformed by rotation of the photoconductive drum 21 immediately after coming into contact with the photoconductive drum 21. In other words, the sheet P is conveyed to the transfer nip 24N while being curved in a rotational direction of the photoconductive drum 21 after the sheet leading end P3 comes into contact with the photoconductive drum 21.

When the sheet leading end P3 is deformed while being in contact with the photoconductive drum 21, the volume of a space S1 defined by the developing nip 23N, the developing housing 234, the first guide member 51, the sheet leading end P3, and the photoconductive drum 21 increases owing to the downward deformation of the sheet leading end P3, and consequently, the pressure in the space S1 decreasingly changes. The deformation of the sheet leading end P3 generates a negative pressure, which causes an air flow in the space S1. The occurrence of air flow in the space S1 may cause developer to scatter at the developer nip 23N, which may result in misalignment of a developer image to be carried on the image carrying surface 21A of the photoconductive drum 21.

Accordingly, in the present embodiment, the distal edge 512A of the tip section 512 is located at such a position in the first guide member 51 to allow a surface P1 of a sheet P having been conveyed along the guide surface 511Aa to lie at the space S2 therefrom, as described above. Owing to the space S2, the space S1 is not closed by the developing nip 23N, the developing housing 234, the first guide member 51, the sheet leading end P3, and the photoconductive drum 21. Accordingly, even when the sheet leading end P3 is deformed upon its contact with the photoconductive drum 21, the generation of negative pressure can be prevented because the space S1 is not closed, and therefore, the pressure change in the space S1 caused by the deformation can be reduced. Consequently, the air flow caused by the deformation of the sheet leading end P3 can be weakened, so that scattering of developer at the developing nip 23N can be prevented. Therefore, it is possible to suppress generation of an imaging failure in a transferred image on the sheet P.

Further, in the present embodiment, as shown in FIGS. 3 and 4, the guide body 511 of the first guide member 51 includes the guide ribs (projections) 511D extending in the sheet conveyance direction H and projecting into the pre-transfer conveyance passage 41. In the present embodiment, the projections 511D constitute the guide surface 511Aa, and the ridge parts 511Da of the projections 511D lie on the lower side Z1 with respect to the distal edge 512A of the leading end 512. Here, the ridge part 511Da of the projection 511D refers to a portion that constitutes the most extreme portion of the projection 511D on the lower side Z1. In addition, the guide surface 511Aa faces a surface P1 of a sheet P at a space S3 therefrom, the space S3 being narrower than the above-mentioned space S2 (S3<S2).

Owing to the projections 511D of the guide body 511, the space S2 is more reliably defined between a surface P1 of a sheet P and the distal edge 512A of the tip section 512, the sheet P having been conveyed along the projections 511D. This makes it possible to reliably prevent formation of the closed space, and more reliably reduce the pressure change caused by deformation of a sheet leading end P3 occurring upon its contact with the photoconductive drum 21. Consequently, the air flow caused by the deformation of the sheet leading end P3 can be weakened. Further, the projections 511D of the guide body 511 define passages for the air flow that occurs by the deformation of the sheet leading end P3, the passages extending along the projections 511D and between the guide body 511 and the sheet P. Consequently, the air flow that occurs by the deformation of the sheet leading end P3 flows through the passages extending along the projections 511D. This makes it possible to more reliably prevent the air flow that occurs by the deformation of the sheet leading end P3 from causing developer to scatter at the developing nip 23N.

In the present embodiment, the plurality of projections 511D are formed at intervals in the first direction X in the guide body 511. The interval between adjacent projections 511D in the first direction X is set in stages according to the sheet widths of sheets P of different sizes that pass through the registration nip 43N. Consequently, it is possible to achieve a good conveyability of the sheets P of different sizes along the projections 511D constituting the guide surface 511Aa in the first guide member 51.

An explanation will be made with reference to FIG. 1. For example, in an image forming apparatus configured such that the transfer nip 24N lies above a tangent line L1 of the second roller 432, the tangent line L1 passing through the registration nip 43N, a sheet leading end P3 of a sheet P having been conveyed by the pair of registration rollers 43 directly enters the transfer nip 24N without making contact with the photoconductive drum 21, so that the leading end P3 does not deform much. In contrast, in the present embodiment, the first guide member 51 lies on the upper side Z2 with respect to the tangent line L1 in a plan view looking in the first direction X, as shown in FIG. 1. In addition, the transfer roller 24 lies on the lower side Z1 with respect to the tangent line L1. In other words, the first guide member 51 and the transfer roller 24 respectively lie on both sides of the tangent line L1 in the plan view looking in the first direction X.

In such configuration, when a sheet leading end P3 of a sheet P having been conveyed along the guide surface 511Aa of the first guide member 51 is guided to the transfer nip 24N immediately after coming into contact with the photoconductive drum 21, the sheet leading end P3 is likely to be deformed. The reason of the necessity to adopt such configuration that is likely to cause deformation of the sheet leading end P3 is to prevent a so-called pre-transfer discharge. If it is configured in such a way as to guide the sheet leading end P3 directly into the transfer nip 24N, an electric charge on the circumferential surface of the photoconductive drum 21 is discharged onto the sheet P at the upstream side of the transfer nip 24N. The occurrence of such pre-transfer discharge causes toner scattering, which results in an imaging failure.

Even in the above-described configuration, in the first guide member 51 according to the present embodiment, the distal edge 512A of the tip section 512 is located at such a position as to allow a surface P1 of a sheet P having been conveyed along the guide surface 511Aa of the guide body 511 to lie at the space S2 therefrom. Therefore, it is possible to reduce the pressure change caused by deformation of the sheet leading end P3 occurring upon its contact with the photoconductive drum 21. Consequently, it is possible to weaken the air flow caused by the deformation of the sheet leading end P3, and in turn, prevent scattering of developer at the developing nip 23N.

In the present embodiment, in the pair of registration rollers 43, the first roller 431 is in the form of a metallic roller, and the second roller 432 is in the form of an elastic roller. In such pair of registration rollers 43, the circumferential surface of the second roller 432 is depressed at the registration nip 43N. Therefore, a sheet P having passed through the registration nip 43N is conveyed in such a way as to slope in the direction of the upper side Z2 where the first roller 431 is disposed, with respect to the tangent line L1 of the second roller 432 passing through the registration nip 43N. As described above, the first guide member 51 is disposed downstream of the pair of registration rollers 43 in the sheet conveyance direction H on the upper side Z2 with respect to the tangent line L1. Consequently, the sheet P having been conveyed through the registration nip 43N in such a manner as to slope in the direction of the upper side Z2 advances to the guide surface 511Aa of the first guide member 51. Therefore, it is possible to allow the sheet P having passed through the registration nip 43N to come into contact with the guide surface 511Aa of the first guide member 51 to be conveyed along the guide surface 511Aa. Thus, it is possible to guide a sheet leading end P3 of the sheet P to the photoconductive drum 21 at high accuracy.

On the other hand, when a sheet P is conveyed along the guide surface 511Aa of the first guide member 51, the space S1 defined by the developing nip 23N, the developing housing 234, the first guide member 51, a sheet leading end P3, and the photoconductive drum 21 is liable to be closed, which is liable to result in a great pressure change caused by deformation of the sheet leading end P3 occurring upon its contact with the photoconductive drum 21. In contrast, in the first guide member 51 according to the present embodiment, the distal edge 512A of the tip section 512 is located at such a position as to allow a surface P1 of a sheet P having been conveyed along the guide surface 511Aa of the guide body 511 to lie at the space S2 therefrom when a sheet leading end P3 is in contact with the photoconductive drum 21. Therefore, it is possible to reduce the pressure change caused by deformation of the sheet leading end P3 occurring upon its contact with the photoconductive drum 21. Consequently, it is possible to weaken the air flow caused by the deformation of the sheet leading end P3, and in turn, to prevent scattering of developer at the developing nip 23N.

In the first guide member 51 according to the present embodiment, the tip section 512 includes, as shown in FIG. 4, a curved portion 512C joining the downstream end edge 511Ab of the guide body 511, the curved portion 512C being curved to bulge outward of the pre-transfer conveyance passage 41 in the direction of the upper side Z2. In addition, the tip section 512 slopes downward toward the distal edge 512A in the direction of the lower side Z1. Owing to the curved portion 512C of the tip section 512 curved in the direction of the upper side Z2, the space S2 is more reliably defined between a sheet P and the tip section 512 of the first guide member 51, the sheet P being conveyed along the guide surface 511Aa. This makes it possible to more reliably reduce the pressure change caused by deformation of a sheet leading end P3 occurring upon its contact with the photoconductive drum 21. Further, the downward sloping of the tip section 512 toward the distal edge 512A in the first guide member 51 makes it possible to enhance the effect of guiding the sheet P to the photoconductive drum 21, the sheet P being conveyed along the guide surface 511Aa.

In the first guide member 51 according to the present embodiment, the tip section 512 includes, as shown in FIG. 4, a bent portion 512B bent from the distal edge 512A in the direction of the upper side Z2. In other words, the bent portion 512B is bent in the direction of the upper side Z2 and further bent back to the upstream side. The bent portion 512B is formed by the so-called hemming, i.e. the working process of bending an end of a material 180 degrees. Owing to the bent portion 512B provided at the distal edge 512A of the tip section 512 of the first guide member 51, it is possible to allow the first guide member 51 to have an improved resistance to deformation, and to achieve good conveyability of a sheet P while preventing the sheet P being conveyed along the guide surface 511Aa from being caught on the distal edge 512A of the leading end 512 upon its contact with the distal edge 512A.

In the first guide member 51 according to the present embodiment, the ridge part 511Da of the projection 511D of the guide body 511 has a curved surface projecting in the direction of the lower side Z1. In this manner, the ridge parts 511Da of the projections 511D constituting the guide surface 511Aa in the guide body 511 of the first guide member 51 each have the curved surface, which makes it possible to achieve good conveyability of a sheet P being conveyed along the guide surface 511Aa.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

What is claimed is:

1. An image forming apparatus, comprising:

an image carrier having an image carrying surface for carrying thereon a developer image that is to be transferred onto a sheet, the image carrier being rotatable about an axis extending in a first direction perpendicularly intersecting a sheet conveyance direction;

a developing section operable to supply developer to the image carrying surface to form the developer image;

a transfer section operable to transfer the developer image formed on the image carrying surface onto a transfer surface of the sheet;

a pre-transfer conveyance passage for allowing conveyance of the sheet from an upstream position of the transfer section in the sheet conveyance direction toward the image carrying surface; and a guide member defining a side of the pre-transfer conveyance passage that faces the transfer surface, wherein:

the guide member includes a guide body in the form of a plate and having a guide surface that faces the transfer surface of the sheet substantially in parallel, the sheet being conveyed in the sheet conveyance direction, and a tip section having a curved portion joining an end edge of the guide body that is on a downstream side in the conveyance direction and defining an outer bulge of the pre-transfer conveyance passage, the curved portion bulging in a second direction perpendicularly intersecting both the sheet conveyance direction and the first direction, and a distal edge that is on a downstream side in the conveyance direction and faces the image carrier;

the transfer section includes a transfer roller coming into contact with the image carrying surface to form a transfer nip portion, and the distal edge of the tip section is located at such a position as to allow the transfer surface of the sheet having been conveyed along the guide surface to lie at a space therefrom when a leading end of the sheet is in contact with the image carrying surface of the image carrier at a position upstream from the transfer nip portion in a rotational direction of the image carrier.

2. The image forming apparatus according to claim 1, wherein the guide body includes a projection extending in the conveyance direction and projecting into the pre-transfer conveyance passage, the projection constituting the guide surface.

3. The image forming apparatus according to claim 1, further comprising:

a pair of conveyance rollers disposed upstream of the guide member in the conveyance direction for conveying the sheet to the transfer section while nipping the sheet, the pair of conveyance rollers including a first roller extending in the first direction and a second roller held in pressed contact with the first roller and thereby defining a nip therebetween, wherein when one side in the second direction refers to one side where the pre-transfer conveyance passage lies with respect to the developing section and the other side in the second direction refers to the opposite side of the one side, the transfer section lies on the one side and the guide member lies on the other side of a tangent line of the second roller in the second direction in a plan view looking in the first direction, the tangent line passing through the nip.

4. The image forming apparatus according to claim 3, wherein:

the curved portion of the tip section curvedly extends in the direction of the other side in the second direction from the end edge of the guide body that is on the downstream side in the conveyance direction; and the tip section slopes downward toward the distal edge in the direction of the one side.

5. The image forming apparatus according to claim 4, wherein the tip section includes a bent portion bent from the distal edge in the direction of the other side in the second direction.

6. The image forming apparatus according to claim 2, wherein the projection includes a ridge part having a curved surface projecting into the pre-transfer conveyance passage.

7. The image forming apparatus according to claim 2, wherein the guide body includes another projection formed at an interval in the first direction.

8. An image forming apparatus, comprising:

an image carrier having an image carrying surface for carrying thereon a developer image that is to be transferred onto a sheet, the image carrier being rotatable about an axis extending in a first direction perpendicularly intersecting a sheet conveyance direction;

a developing section operable to supply developer to the image carrying surface to form the developer image;

a transfer section operable to transfer the developer image formed on the image carrying surface onto a transfer surface of the sheet;

a pre-transfer conveyance passage for allowing conveyance of the sheet from the developing section to the transfer section; and a guide member defining a side of the pre-transfer conveyance passage that faces the transfer surface, wherein:

the guide member includes a guide body in the form of a plate and having a guide surface that faces the transfer surface of the sheet substantially in parallel, the sheet being conveyed in the sheet conveyance direction, and a tip section having a curved portion joining an end edge of the guide body that is on a downstream side in the conveyance direction and defining an outer bulge of the pre-transfer conveyance passage, the curved portion bulging in a second direction perpendicularly intersecting both the sheet conveyance direction and the first direction, and a distal edge that is on a downstream side in the conveyance direction and faces the image carrier;

the distal edge of the tip section is located at such a position as to allow the transfer surface of the sheet having been conveyed along the guide surface to lie at a space therefrom when a leading end of the sheet is in contact with the image carrying surface of the image carrier, the developing section includes a developing roller and a developing housing that houses the developing roller; and the guide member is attached to the developing housing.

9. The image forming apparatus according to claim 8, wherein the developing housing includes a bottom wall on a lower side thereof, and the guide member is attached to the bottom wall.

* * * * *